US010407963B2

(12) United States Patent
Salice

(10) Patent No.: US 10,407,963 B2
(45) Date of Patent: Sep. 10, 2019

(54) DECELERATED HINGE FOR FURNITURE

(71) Applicant: ARTURO SALICE S.P.A, Novedrate (IT)

(72) Inventor: Luciano Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 30 days.

(21) Appl. No.: 15/569,455

(22) PCT Filed: Apr. 27, 2016

(86) PCT No.: PCT/EP2016/059375
§ 371 (c)(1),
(2) Date: Oct. 26, 2017

(87) PCT Pub. No.: WO2016/174071
PCT Pub. Date: Nov. 3, 2016

(65) Prior Publication Data

US 2018/0252016 A1 Sep. 6, 2018

(30) Foreign Application Priority Data

Apr. 30, 2015 (IT) ..... MI2015A0619

(51) Int. Cl.
*E05F 1/08* (2006.01)
*E05F 5/02* (2006.01)
(Continued)

(52) U.S. Cl.
CPC ..... *E05F 5/027* (2013.01); *E05D 3/142* (2013.01); *E05D 7/0407* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 2,039,130 A * 4/1936 Van Note ..... E05D 3/06 16/278
3,008,178 A * 11/1961 Hofgesang ..... A47B 29/00 16/287
(Continued)

FOREIGN PATENT DOCUMENTS

DE 202006010482 U1 11/2007
EP 2057337 B1 * 9/2018 ..... E05F 5/006
WO WO 2009/003458 A1 1/2009

OTHER PUBLICATIONS

International Search Report and Written Opinion dated Jun. 29, 2016 issued in PCT/EP2016/059375.
(Continued)

*Primary Examiner* — Chuck Y Mah
(74) *Attorney, Agent, or Firm* — Scully, Scott, Murphy & Presser, P.C.

(57) ABSTRACT

A hinge for leaves of furniture and the like, which comprises a fixed part which is shaped to be inserted in a seat provided within the thickness of an upper or lower wall of a piece of furniture and a moveable part which can be connected to a leaf of the piece of furniture, the fixed part and the moveable part being mutually connected so as to oscillate by way of an articulation system which comprises at least one articulation axis and a rocker, the hinge further comprising elastic elements for closing the hinge which are functionally connected to the at least one rocker, and a deceleration device which is adapted to decelerate at least part of the closing and/or opening motion of the hinge, the deceleration device
(Continued)

being actuated by actuation elements which are entirely concealed within the fixed part of the hinge.

10 Claims, 11 Drawing Sheets

(51) Int. Cl.

| | |
|---|---|
| ***E05D 3/14*** | (2006.01) |
| ***E05D 7/04*** | (2006.01) |
| ***E05D 11/10*** | (2006.01) |
| ***E05F 1/12*** | (2006.01) |
| ***E05F 5/00*** | (2017.01) |
| ***E05F 1/10*** | (2006.01) |

(52) U.S. Cl.
CPC ..... *E05D 7/0415* (2013.01); *E05D 7/0423* (2013.01); *E05D 11/1021* (2013.01); *E05F 1/1066* (2013.01); *E05F 1/1253* (2013.01); *E05F 5/006* (2013.01); *E05Y 2600/41* (2013.01); *E05Y 2600/452* (2013.01); *E05Y 2900/20* (2013.01)

(58) Field of Classification Search
CPC ..... E05Y 2201/21; E05F 5/006; E05F 5/02; E05F 5/027; E05D 11/1021; E05D 11/1042; E05D 11/105; E05D 11/1064; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS 3,628,217 A * 12/1971 Schaber ..... E05D 11/1064 16/292
4,083,082 A * 4/1978 Holmes ..... E05D 3/142 16/288
4,177,540 A * 12/1979 Gorton ..... E05D 11/1014 16/237
4,365,384 A * 12/1982 Vitt ..... E05D 11/1021 16/333
4,658,473 A * 4/1987 Schema ..... E05F 1/1261 16/286
4,827,569 A * 5/1989 Mertes ..... E05D 3/16 16/288
5,012,551 A * 5/1991 Beneke ..... E05F 5/006 16/49
5,269,043 A * 12/1993 Yang ..... E05F 5/006 16/68
7,810,212 B2 * 10/2010 Salice ..... E05D 11/1021 16/286
8,321,996 B2 * 12/2012 Hirtsiefer ..... E05D 3/14 16/286
8,561,262 B1 * 10/2013 Liang ..... E05F 5/006 16/286
8,689,402 B2 * 4/2014 Brunnmayr ..... E05F 5/006 16/286
2007/0136990 A1 * 6/2007 Salice ..... E05D 5/08 16/282
2011/0298349 A1 * 12/2011 Sutterlutti ..... E05F 5/006 312/326
2012/0174338 A1 * 7/2012 Wu ..... E05F 5/006 16/297
2013/0000075 A1 * 1/2013 Forster ..... E05F 5/006 16/84
2013/0067686 A1 * 3/2013 Migliorini ..... E05D 3/16 16/298
2014/0165333 A1 * 6/2014 Brunnmayr ..... E05F 5/006 16/319
2014/0359973 A1 * 12/2014 Ng ..... E05D 7/00 16/225
2014/0366322 A1 * 12/2014 Salice ..... E05F 5/006 16/277

OTHER PUBLICATIONS

Italian Search Report dated Dec. 15, 2015 issued in IT MI20150619, with partial translation.

* cited by examiner

DECELERATED HINGE FOR FURNITURE

CROSS-REFERENCE TO RELATED APPLICATIONS

This Application is a 371 of International Application PCT/EP2016/059375, filed on Apr. 27, 2016, which claims priority to Application MI2015A000619 filed on Apr. 30, 2015.

BACKGROUND OF THE DISCLOSURE

The present invention relates to a decelerated hinge for furniture. More specifically, the invention relates to a decelerated hinge for leaves of furniture or the like, which has a fixed part or wing which is shaped to be inserted in a seat provided in the thickness of the upper or lower wall of the piece of furniture.

As is known, in the furniture sector, in order to support leaves of furniture so as to oscillate, usually the use is made of hinges that comprise a fixed part, which can be connected to a wall of the body of the piece of furniture, and a moveable part, constituted by a box-like body, which can be connected to the leaf of the same piece of furniture, such parts being mutually articulated so as to oscillate by way of at least one rotation axis and more preferably by way of an articulation system that comprises articulation axes and connecting rockers.

In order to maintain the leaf in the closed position, the hinges likewise comprise elastic means that are adapted to push an arm of the fixed part, or the articulation system, in the direction of closure of the hinge.

However, owing to the presence of such elastic means, the leaf, at its closed position, slams against the body of the piece of furniture with force, causing undesirable and unacceptable noise.

In order to overcome the above problem, it has been variously proposed to adopt a deceleration device, for example of the linear type or of the rotation type, associated with one of the parts of the hinge, in order to dampen the closing movement of the hinge.

However, the known solutions for arranging and actuating deceleration devices are not suitable or cannot be applied to a different, completely invisible type of hinge, in which the fixed part or wing has a flat shape structure in order to be insertable in a seat provided in the thickness of the upper or lower wall of the piece of furniture, and in which the rockers extend according to a plane perpendicular to the articulation axes, owing to the shape structure of the fixed part of the hinge and owing to the shape structure and arrangement of the rockers.

The aim of the present invention is to devise a decelerated hinge for leaves of furniture or the like, of the type that has a fixed part or wing which is shaped to be insertable in a seat provided in the thickness of the upper or lower wall of the piece of furniture, which has a deceleration device that is positioned and actuated so as to provide an effective decelerating action and which can be easily put together with the other parts of the hinge.

BRIEF SUMMARY OF THE DISCLOSURE

Within this aim, an object of the present invention is to devise a decelerated hinge for leaves of furniture or the like, in which the hinge, once mounted on the piece of furniture, has the actuation means of the deceleration device substantially entirely in-wall, with therefore only the rockers of the hinge being visible.

Another object of the present invention is to devise a decelerated hinge for leaves of furniture or the like, in which the relative position between the fixed part of the hinge and the moveable part is adjustable.

Another object of the present invention is to devise a decelerated hinge for door leaves of furniture or the like which is highly reliable, easily and practically implemented and low cost.

This aim and these and other objects which will become better apparent hereinafter are achieved by a hinge for leaves of furniture and the like, which comprises a fixed part which is shaped to be inserted in a seat provided within the thickness of an upper or lower wall of a piece of furniture and a moveable part which can be connected to a leaf of the piece of furniture, the fixed part and the moveable part being mutually connected so as to oscillate by way of an articulation system which comprises at least one articulation axis and a rocker, the hinge comprising elastic means for closing the hinge which are functionally connected to said at least one rocker, characterized in that it comprises a deceleration device which is adapted to decelerate at least part of the closing and/or opening motion of the hinge, said deceleration device being actuated by actuation means which are entirely concealed within said fixed part of the hinge.

BRIEF DESCRIPTION OF THE SEVERAL VIEWS OF THE DRAWINGS

Further characteristics and advantages of the invention will become better apparent from the description of preferred, but not exclusive, embodiments of the decelerated hinge according to the present invention, which are illustrated by way of non-limiting example in the accompanying drawings, wherein.

DETAILED DESCRIPTION OF THE DISCLOSURE

Figure 1:
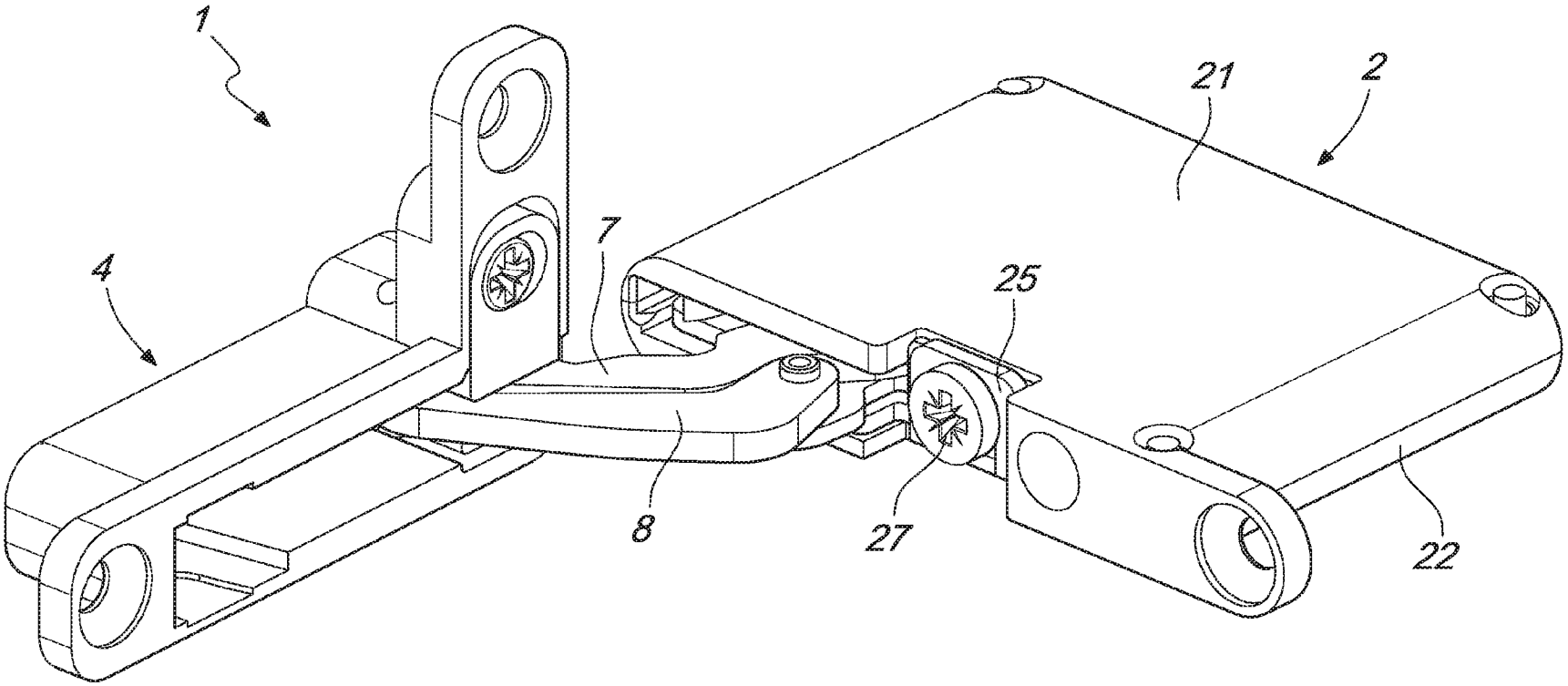
FIG. 1 is a perspective view of a hinge according to the present invention.
Figure 2:
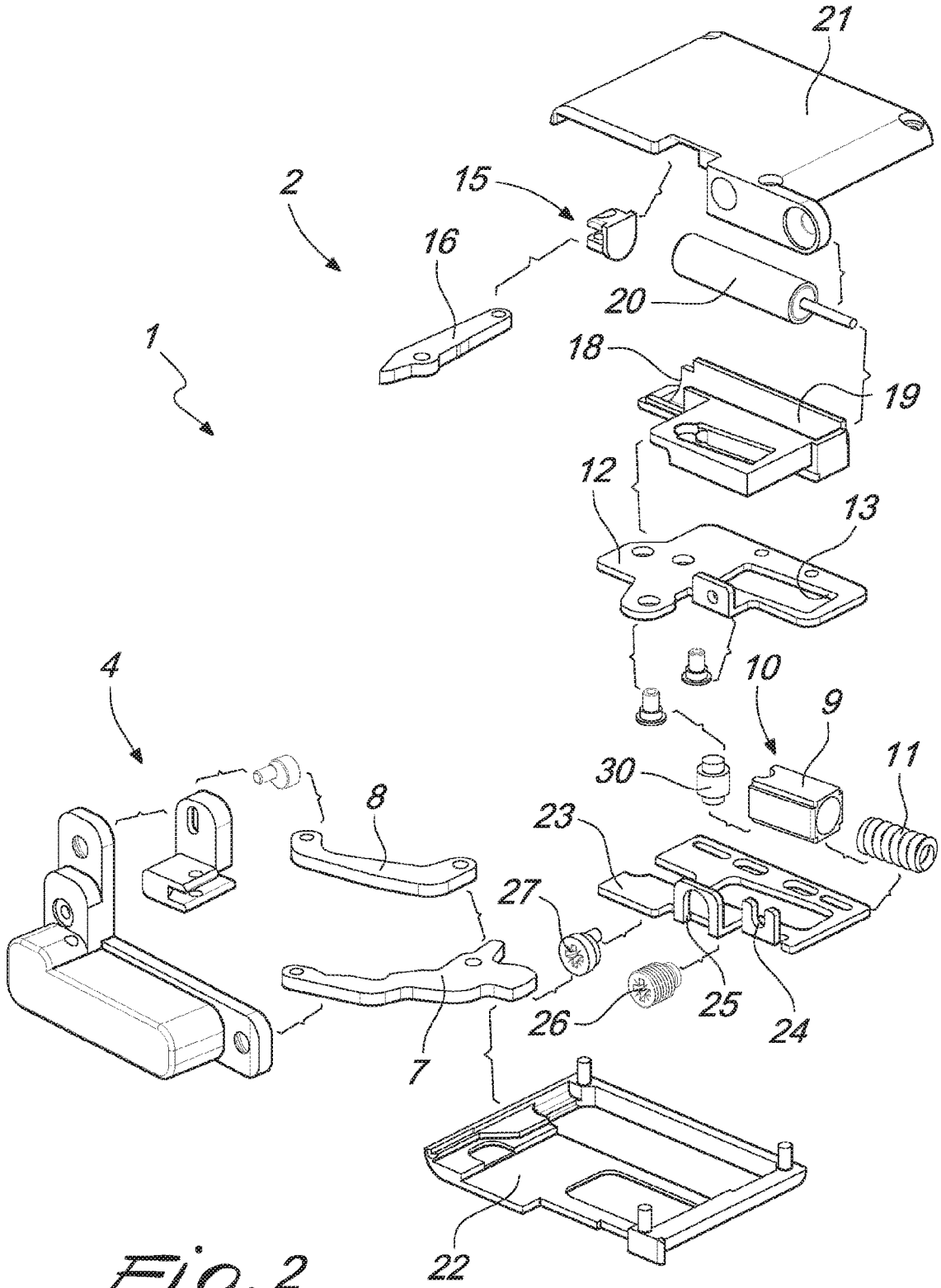
FIG. 2 is an exploded perspective view of the hinge according to the present invention.
Figure 3:
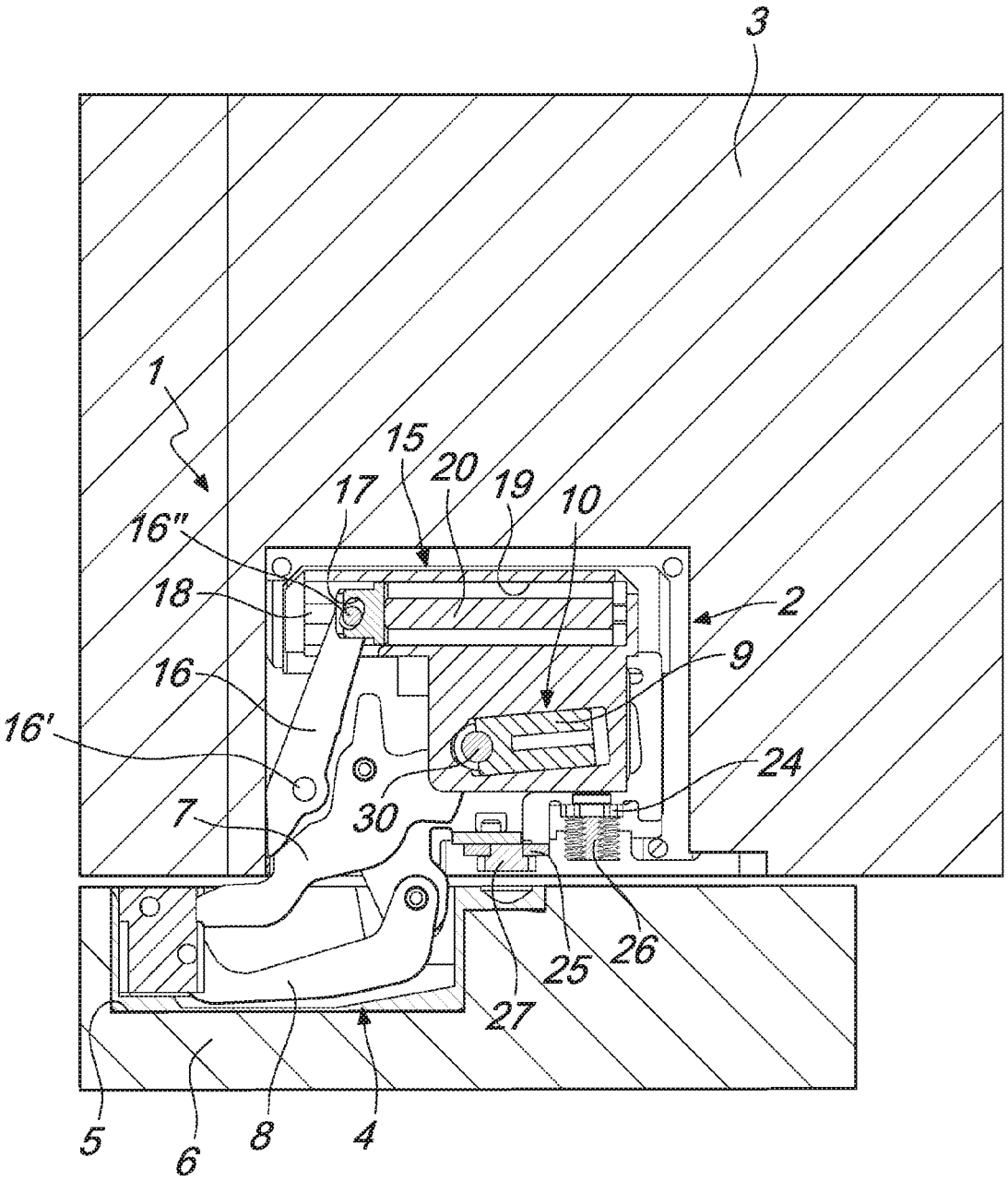
FIG. 3 is a cross-sectional view of the hinge according to the present invention installed in a piece of furniture, with the leaf in the closed condition.
Figure 4:
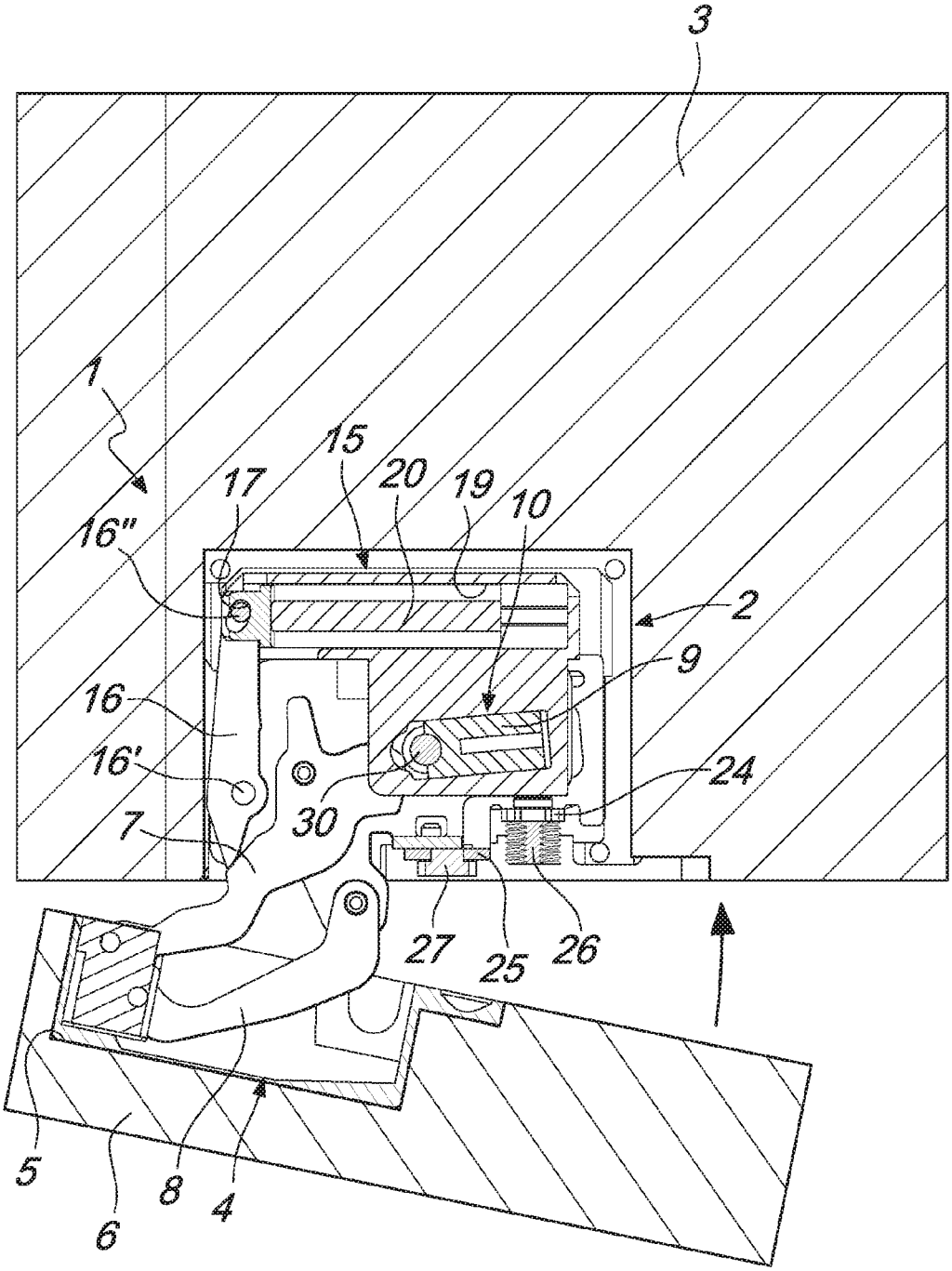
FIGS. 4 and 5 are cross-sectional views of the hinge according to the invention, installed in a piece of furniture, at two different moments during the step of closing the leaf in which the decelerator is actuated.
Figure 5:
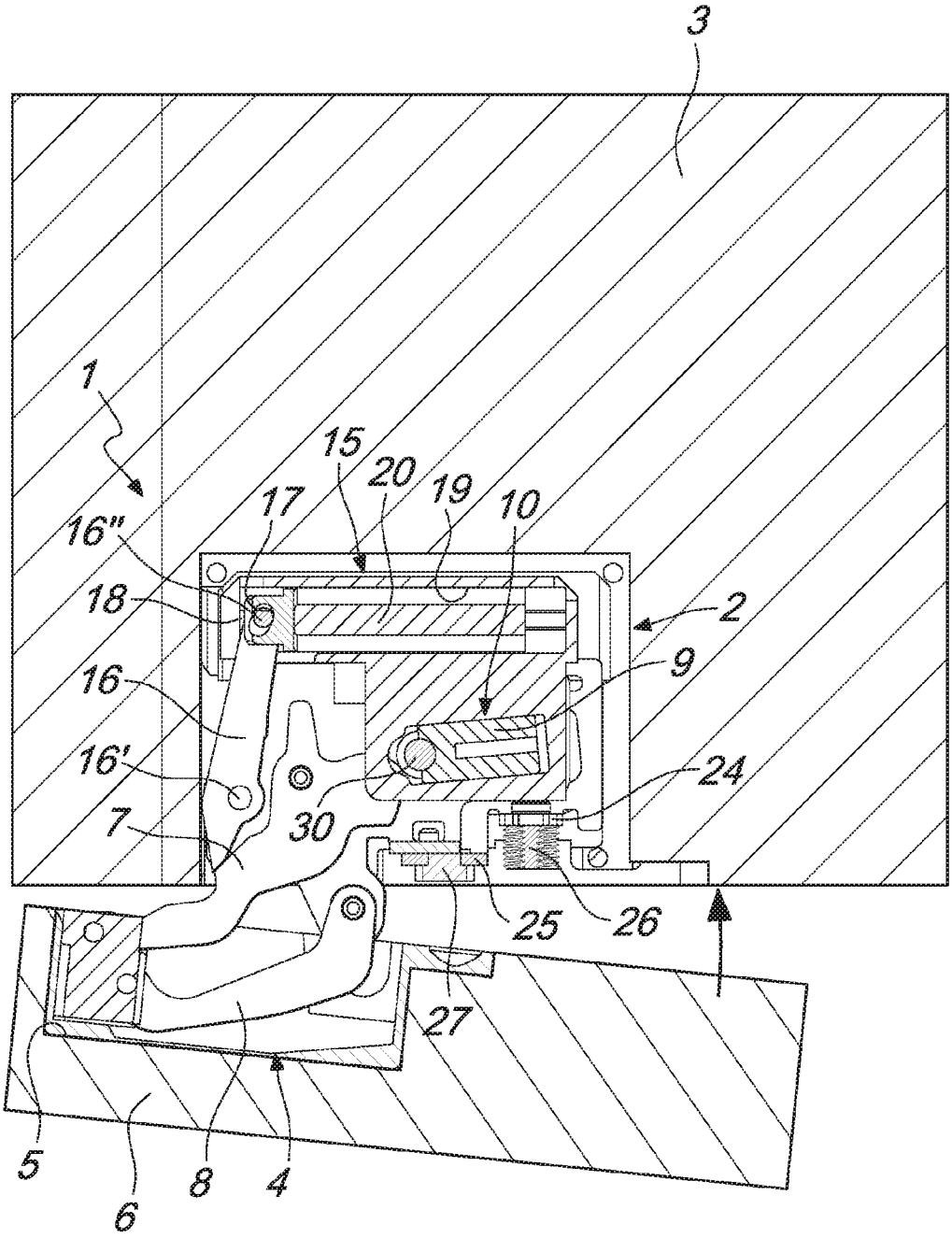
Figure 6:
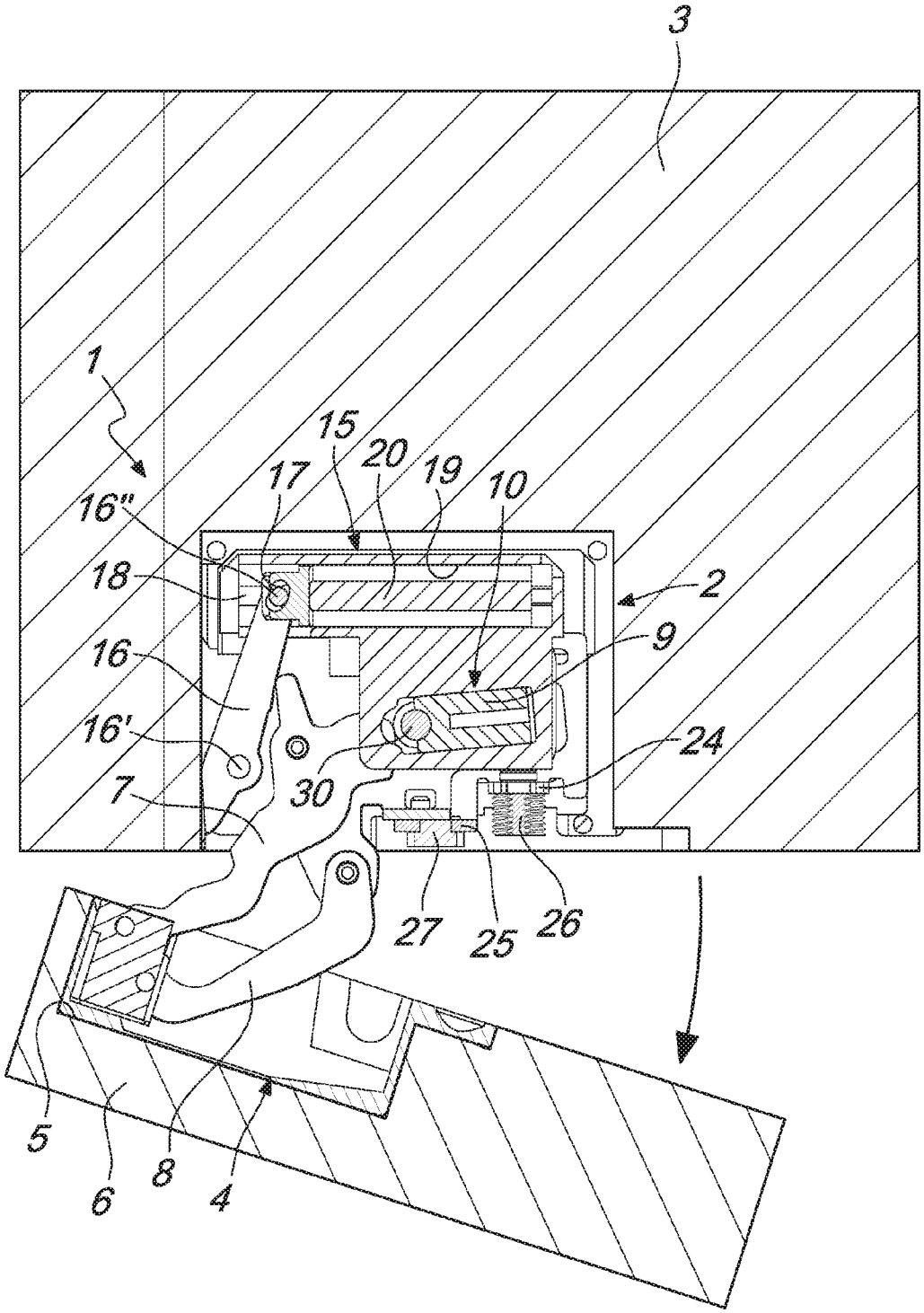
FIGS. 6 to 8 are cross-sectional views of the hinge according to the invention, at different moments during the step of opening the leaf until the position in which the leaf is fully open in FIG. 8 in which the decelerator is fully rearmed.
Figure 7:
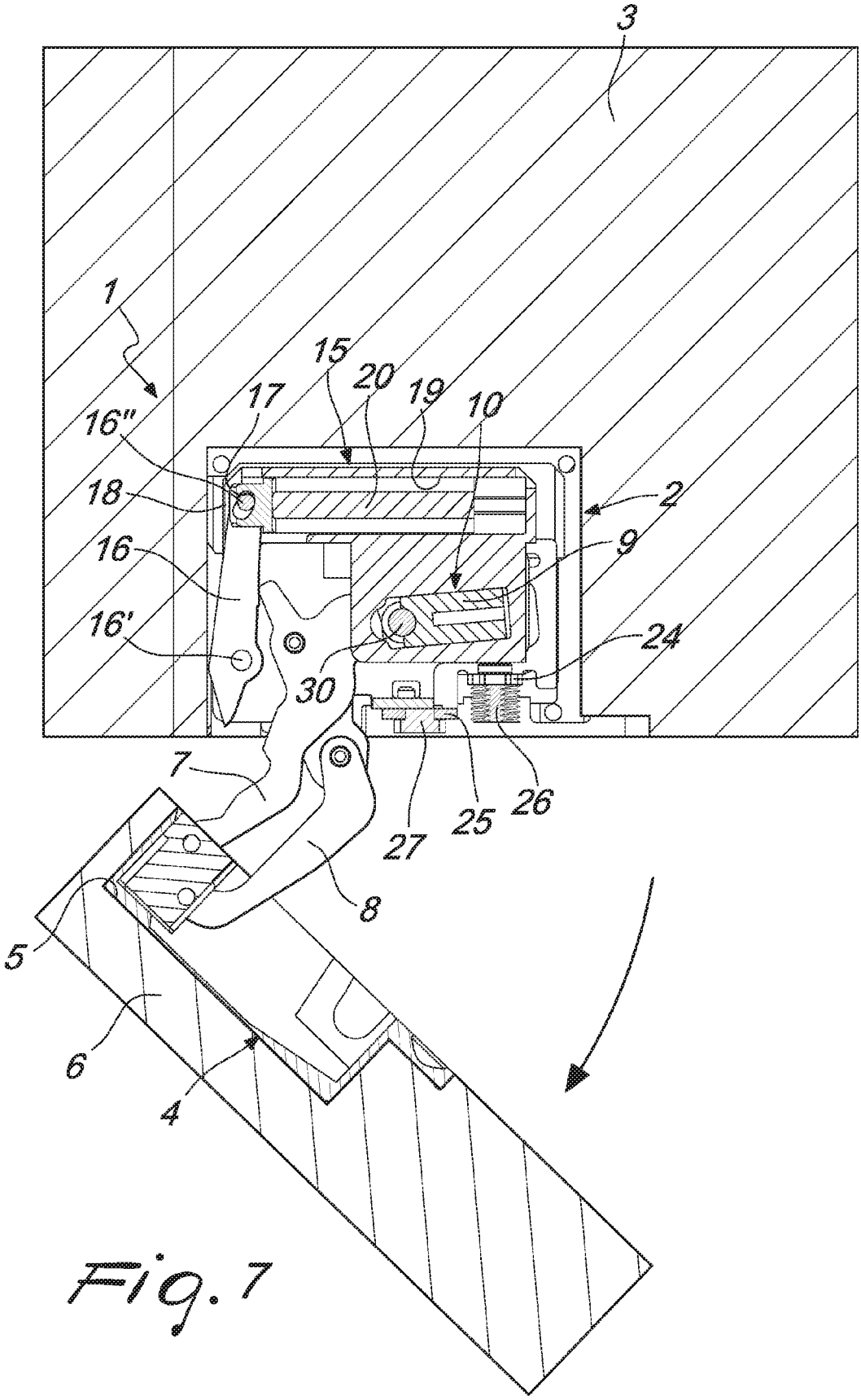
Figure 8:
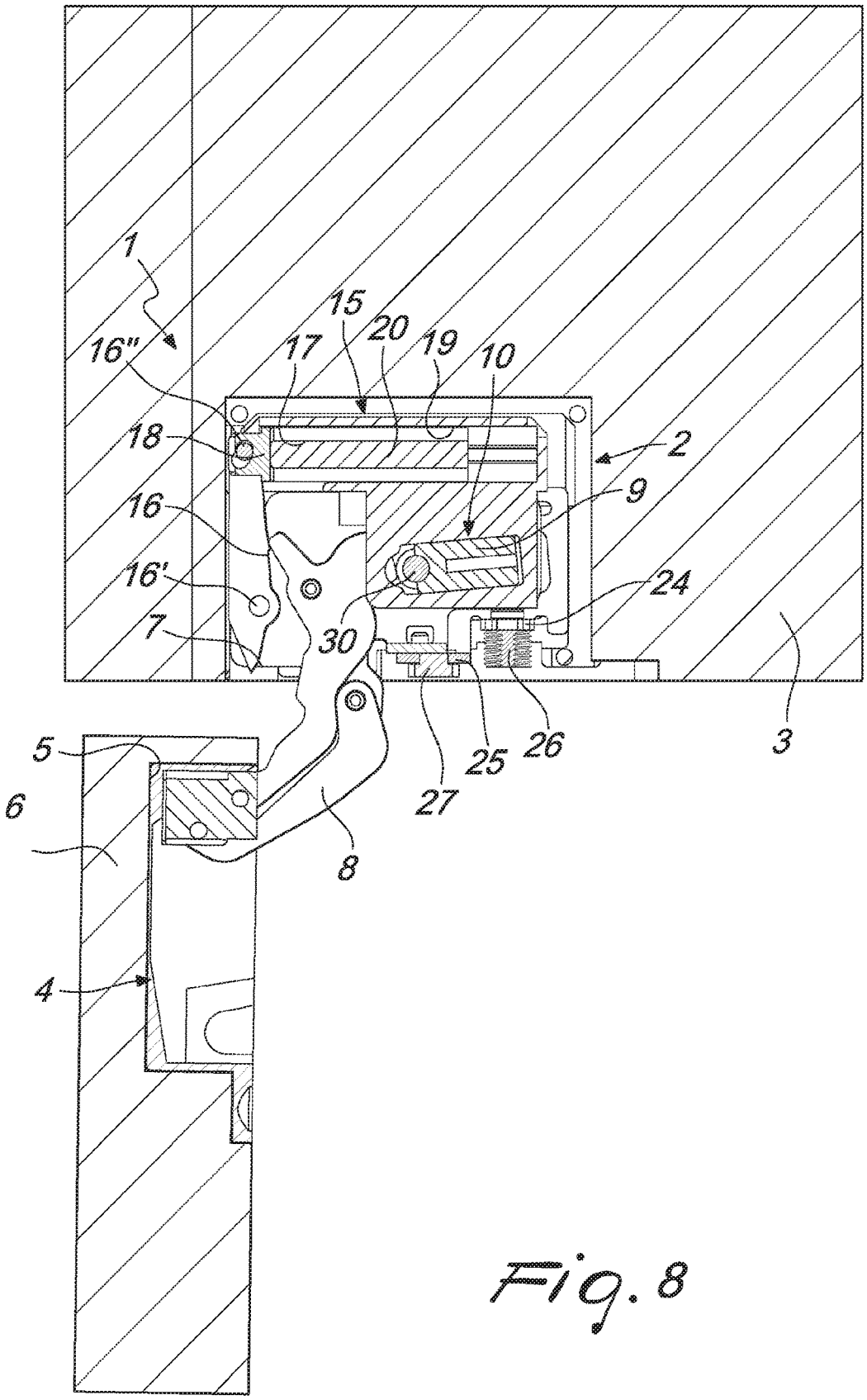
Figure 9:
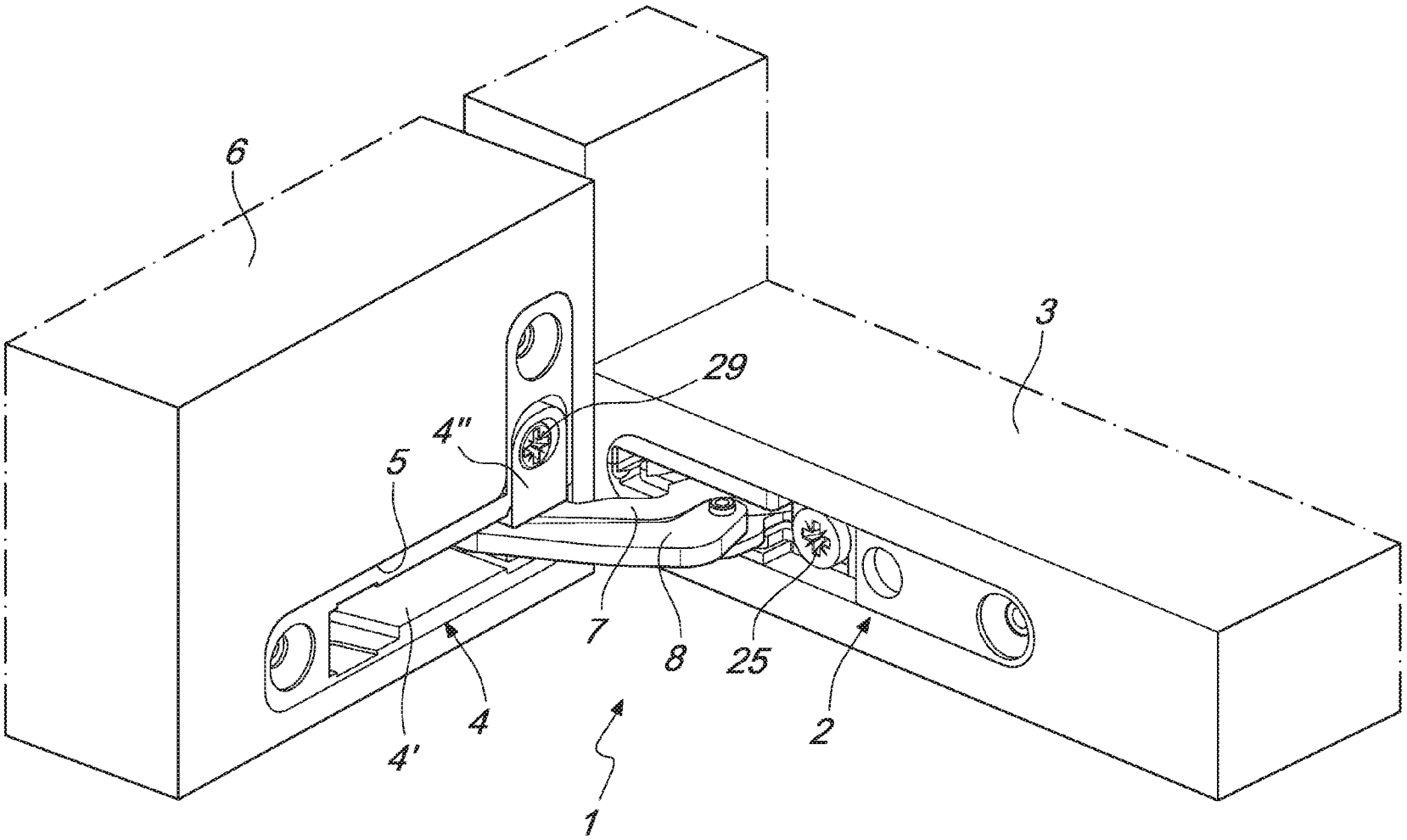
FIG. 9 is a perspective view of the hinge according to the invention installed in a piece of furniture, in the position in which the leaf is open.

With reference to the figures, the hinge according to the invention, which is generally designated by the reference numeral 1, comprises a fixed part or wing which is shaped to be inserted in a seat provided in the thickness of the upper or lower wall of a piece of furniture 3, and a moveable part 4 which is adapted to be inserted in a seat 5 defined in a leaf 6 of the piece of furniture; preferably the moveable part 4 comprises a box-like first part 4' which can be fixed to the leaf 6, a second part 4" connected to the first part 4' so that it can slide vertically, and an eccentric adjustment element 29 which makes it possible to define the relative position between the parts in order to obtain the vertical adjustment of the hinge and therefore of the leaf.

The hinge comprises at least one rocker and more preferably a pair of rockers 7, 8 and four pins which are adapted to define an articulated quadrilateral and allow the articulation of the moveable part 4, in particular of the second part 4", with respect to the fixed part 2.

Conveniently, the fixed part 2 is flat so as to be insertable in a seat provided in the piece of furniture 3.

With this shape structure, the hinge is completely in-wall and the only visible portions are the rockers 7 and 8, which remain exposed to view when the leaf of the piece of furniture is open.

The elastic means conveniently comprise a spring 11 accommodated in a box-like body 9 at the end of which there is a catch 30 which engages with the rocker 7 and more precisely with a cam-shaped part thereof in order to obtain a thrust in the closed position of the hinge.

The rockers 7 and 8 are pivoted on a plate-like element 12 which is provided with a cavity 13 which makes it possible to accommodate the box-like element 12 of the elastic means 10.

The hinge according to the invention further comprises a deceleration device 15 which is actuatable by way of at least one of the rockers 7, 8, directly or by way of adapted transmission means.

The deceleration device makes it possible to decelerate at least one part of the closing and/or opening motion of the hinge according to the invention.

The actuation of the deceleration device 15 preferably occurs by way of lever means 16 which are pivoted on the plate-like element 12 at a pin 16' and are actuated by the rocker 7 in its movement connected to the leaf 6 of the piece of furniture.

Conveniently, in the first embodiment of the invention, illustrated in FIGS. 1 to 9, the lever means 16 have, at one end, a peg 16" which is coupled within a slot 17 of an element for placing the deceleration device 15 under stress.

In the hinge according to the invention, the deceleration device 15 is accommodated within a supporting body 18 which rests on the plate-like element 12, the supporting body having a seat 19 for the accommodation of a cylinder 20 of the deceleration device 15. The fixed part of the hinge, 2, is enclosed in a box-like body which is defined by an upper enclosure 21 and a lower enclosure 22.

The plate-like element 12 and the supporting body 18 as well as the deceleration device are all supported by a lower plate-like element 23, which is provided with seats 24 and 25 respectively for the accommodation of frontal adjustment means 26 and lateral adjustment means 27.

The frontal adjustment means 26, preferably of the screw type, make it possible to act on the distance between the upper enclosure 21 and the plate-like element 23 while the lateral adjustment means 25, preferably of the cam type, make it possible to act on the plate-like element 12 by moving it laterally with respect to the plate-like element 23.

The adjustment means conveniently comprise actuation means that can be maneuvered, for example screw head-type slots.

The adjustment means are accessible to the user from the frontal side of the piece of furniture within which the hinge is mounted, and therefore make possible an easy and rapid adjustment.

In the hinge according to the invention therefore, the actuation means 16 of the deceleration device 15 are fully accommodated in the fixed part 2 of the hinge, so that when the leaf is open the only portions of the hinge that can be seen are the rockers 7 and 8.

In particular, it should be noted that in the hinge according to the invention, the rockers 7, 8 and the actuation means 16 are mutually coplanar, all pivoted on the plate-like element 12.

Furthermore, the adjustment means 26 and 27 make it possible to perform an adjustment of the relative position between the piece of furniture 3 and the fixed part 2 and/or the moveable part 4 of the hinge in at least one of the directions: lateral, frontal and vertical.

The system of transmission between the deceleration device and the at least one actuation rocker 7 comprises, as we have seen, at least one oscillating lever 16, and such lever is co-planar with the rocker that actuates it; in particular, during the last portion of the closing movement of the hinge, the rocker 7 comes into contact by way of a surface thereof with an end of the lever 16 which is arranged, with respect to the oscillation pin 16' of the lever, opposite the end in which the peg 16" is provided.

The oscillating lever 16 pivoted on the plate-like element 12 is only connected at one end to the deceleration device 15 by way of the slot 17, and is disconnected from the rocker for actuating the hinge at the other end.

Figure 10:
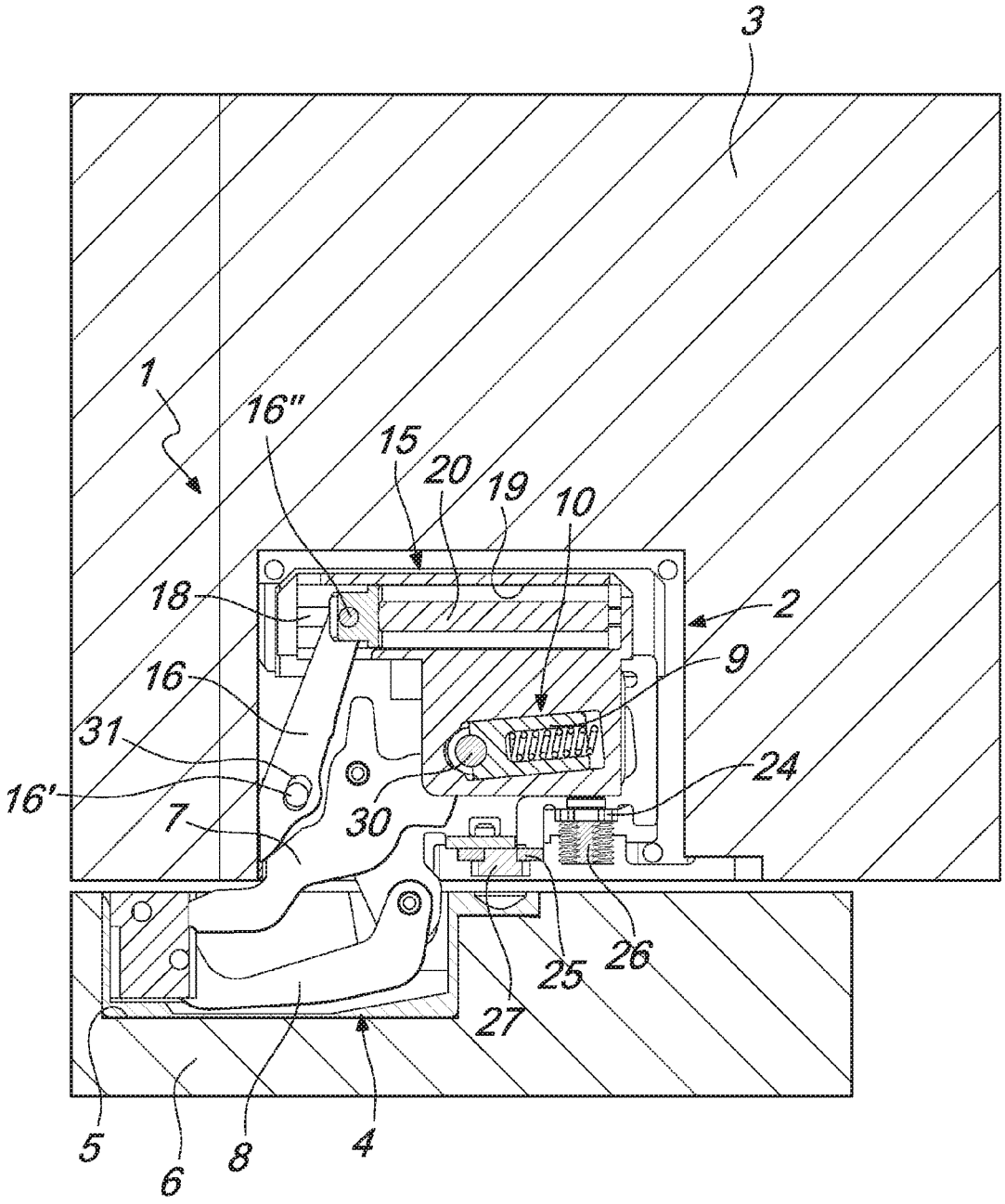
FIG. 10 is a cross-sectional view of a second embodiment of the hinge according to the present invention.

In a second embodiment, shown in FIG. 10, the oscillating lever 16 is instead supported on the plate-like element 12 so that it can slide by way of a slot 31, while it is pivoted in a fixed manner to the deceleration device 15, instead of being moveable within the slot 17 defined in the deceleration device 15, as illustrated in FIGS. 1 to 9.

Figure 11:
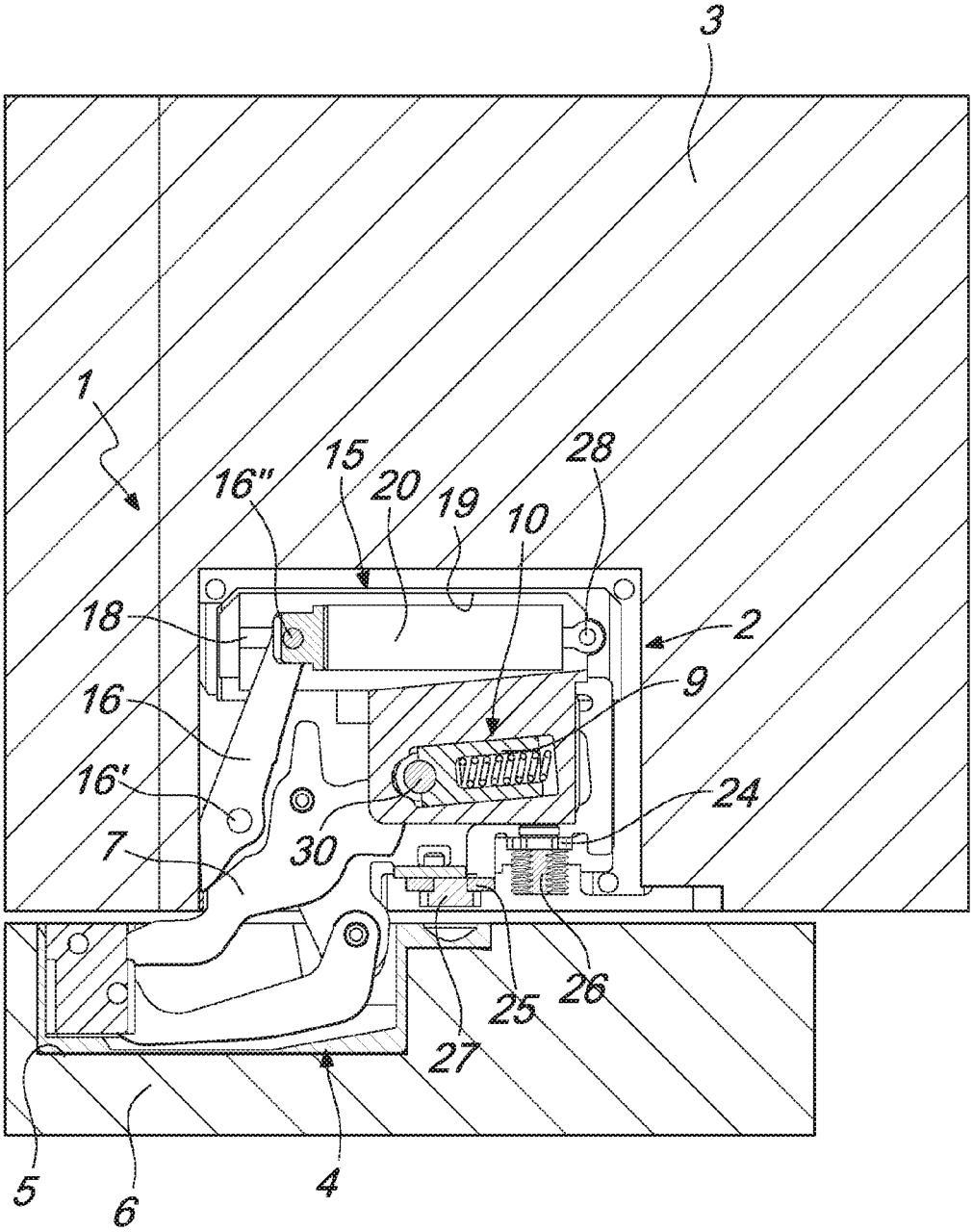
FIG. 11 is a cross-sectional view of a third embodiment of the hinge according to the present invention.

In a third embodiment, shown in FIG. 11, the oscillating lever 16 is supported so as to oscillate but not slide on the plate-like element 12 by way of the pin 16' and is pivoted in a fixed manner to the deceleration device 15 or to an element for stressing it by way of the peg 16"; in such embodiment, in order to work, the cylinder 20 must however be accommodated in its seat 19 so as to oscillate, for example about the fulcrum 28.

Further embodiments are also possible, one of which for example, in order to actuate the deceleration device, does not have the lever means described above, but cam means which are actuated for example by the elastic means 10 and are connected to the deceleration device by way of adapted transmission means.

In practice it has been found that the hinge according to the present invention fully achieves the set aim and objects, in that it can be fully accommodated with its fixed part and its moveable part respectively in the body and in the leaf of the piece of furniture, with no part of the hinge except the rocker or rockers which protrude into view. The deceleration device is hidden within the fixed part of the hinge, as are the actuation means of such deceleration devices.

Furthermore, the hinge makes it possible to adjust the relative position between the piece of furniture, the fixed part, and/or the moveable part of the hinge.

The hinge, thus conceived, is susceptible of numerous modifications and variations, all of which are within the scope of the appended claims.

Moreover, all the details may be substituted by other, technically equivalent elements.

In practice the materials employed, and the contingent dimensions and shapes, may be any according to requirements and to the state of the art.

The disclosures in Italian Patent Application No. MI2015A000619 (102015902347517) from which this application claims priority are incorporated herein by reference.

The invention claimed is:

1. A hinge for leaves of furniture and the like, which comprises a fixed part which is shaped to be inserted in a seat provided within the thickness of an upper or lower wall of a piece of furniture and a moveable part which can be connected to a leaf of the piece of furniture, the fixed part and the moveable part being mutually connected so as to oscillate by way of an articulation system which comprises at least two articulation axes and at least one rocker, the hinge comprising elastic means for closing the hinge which are functionally connected between the at least one rocker and the fixed part, comprising a deceleration device which is adapted to decelerate at least part of the closing and/or opening motion of the hinge, and wherein said deceleration device is actuated by actuation means which are entirely concealed within said fixed part of the hinge, and wherein said deceleration device can be actuated directly or indirectly by way of said at least one rocker.

2. The hinge according to claim 1, wherein said actuation means comprise a lever that is supported so as to oscillate and slide by said fixed part of the hinge and is connected to said deceleration device.

3. The hinge according to claim 1, wherein said actuation means comprise a lever that is supported so as to oscillate by said fixed part of the hinge and is connected to said deceleration device, said deceleration device being accommodated so as to oscillate in said fixed part of the hinge.

4. The hinge according to claim 1, wherein said deceleration device is mounted on a supporting body, which in turn is mounted on a plate-like element on which said at least one rocker and said actuation means are pivoted.

5. The hinge according to claim 4, wherein said deceleration device is mounted on said supporting body, which in turn is mounted on said plate-like element, said deceleration device, said supporting body and said plate-like element being accommodated within said fixed part of the hinge.

6. The hinge according to claim 4, further comprising means for adjustment for varying a distance between an upper enclosure of the hinge and a lower plate-like element that supports said plate-like element and the supporting body as well as the deceleration device, and means for adjustment for moving the plate-like element laterally with respect to the lower plate-like element.

7. The hinge according to claim 6, wherein the adjustment means have actuation means that can be accessed from the front side of the body of the piece of furniture with the hinge mounted.

8. The hinge according to claim 1, wherein said at least one rocker and said actuation means of the deceleration device are mutually coplanar.

9. A hinge for leaves of furniture and the like, which comprises a fixed part which is shaped to be inserted in a seat provided within the thickness of an upper or lower wall of a piece of furniture and a moveable part which can be connected to a leaf of the piece of furniture, the fixed part and the moveable part being mutually connected so as to oscillate by way of an articulation system which comprises at least two articulation axes and at least one rocker, the hinge comprising elastic means for closing the hinge which are functionally connected between the at least one rocker and the fixed part, comprising a deceleration device which is adapted to decelerate at least part of the closing and/or opening motion of the hinge, and wherein said deceleration device is actuated by actuation means which are entirely concealed within said fixed part of the hinge, and wherein said actuation means comprise a lever that is supported so as to oscillate by said fixed part of the hinge and is connected to said deceleration device slideably in a slot of an element for placing the deceleration device under stress.

10. The hinge according to claim 9, wherein said lever that is supported so as to oscillate is actuated by said at least one rocker.

* * * * *